US007458471B2

(12) United States Patent
Crudgington, Jr.

(10) Patent No.: US 7,458,471 B2
(45) Date of Patent: Dec. 2, 2008

(54) STEMWARE SAVER FOR DISHWASHER

(76) Inventor: Cleveland B. Crudgington, Jr., 222 N. Myrtle Ave., Monrovia, CA (US) 91016-2243

( * ) Notice: Subject to any disclaimer, the term of this patent is extended or adjusted under 35 U.S.C. 154(b) by 206 days.

(21) Appl. No.: 11/321,522

(22) Filed: Dec. 19, 2005

(65) Prior Publication Data

US 2006/0138064 A1 Jun. 29, 2006

Related U.S. Application Data

(60) Provisional application No. 60/639,507, filed on Dec. 29, 2004.

(51) Int. Cl.
*A47G 19/08* (2006.01)

(52) U.S. Cl. ..... 211/41.9

(58) Field of Classification Search ..... 211/41.9, 211/41.2, 41.3, 13.1, 41.4, 70.7, 81, 60.1, 211/69.1, 78, 168, 183; D32/3; 510/218; 220/572; 224/318

See application file for complete search history.

(56) References Cited

U.S. PATENT DOCUMENTS 3,318,457 A * 5/1967 Krasnoff ..... 211/74
4,635,799 A * 1/1987 Penner ..... 211/41.9
4,787,591 A * 11/1988 Villacorta ..... 248/316.7
4,927,033 A * 5/1990 Patera et al. ..... 211/41.9
5,580,025 A * 12/1996 Cross ..... 248/507
5,772,166 A * 6/1998 Adams ..... 248/231.81
6,364,131 B1 * 4/2002 Moylan ..... 211/41.9
6,394,285 B1 * 5/2002 Arthurs et al. ..... 211/41.9
2005/0236345 A1 * 10/2005 Herbst et al. ..... 211/41.9

* cited by examiner

*Primary Examiner*—Sarah Purol
(74) *Attorney, Agent, or Firm*—Russell Tarleton; Seed IP Law Group

(57) ABSTRACT

Referred to as the "Stemware Saver" or "Stemsaver", this assembled device is specifically designed to be installed in a conventional household dishwasher for the purpose of holding or cradling one stemmed glassware of any size or configuration in a preferred inverted orientation so as to be properly angled for cleaning and likewise securing the glass against inadvertent movement during the washing or rinsing cycles wherein such movement could result in inadequate cleaning or even breakage. The assembly is comprised of a mounting base that clamps to one of the upright wire prongs within the dishwasher's holding rack, a swiveling holding cradle for securing the stem of the glass, and a pivoting arm with one end snapping onto the mounting base and the other end for the holding cradle's attachment. The pivoting arm in connection with its swiveling cradle provides considerable flexibility in positioning stemmed glassware at a desired angle for washing and rinsing thereby preventing trapped rinse water from leaving an unsightly residue. The Stemware Saver can be folded out of the way when not in use so not to interfere with the placement and washing of non-stemware items.

15 Claims, 5 Drawing Sheets

FIG. 5
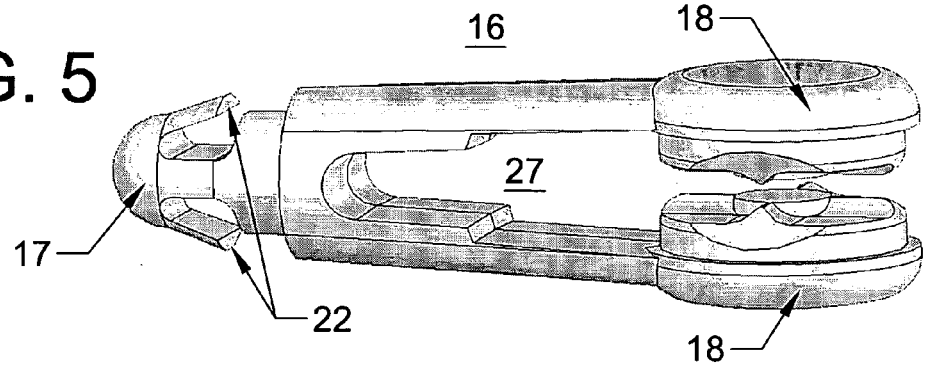
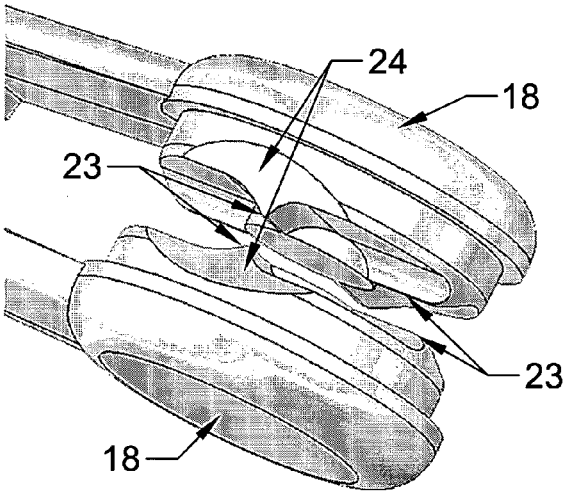
FIG. 6
FIG. 7
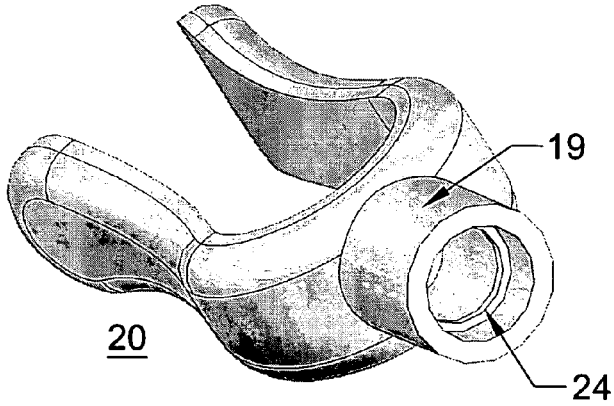

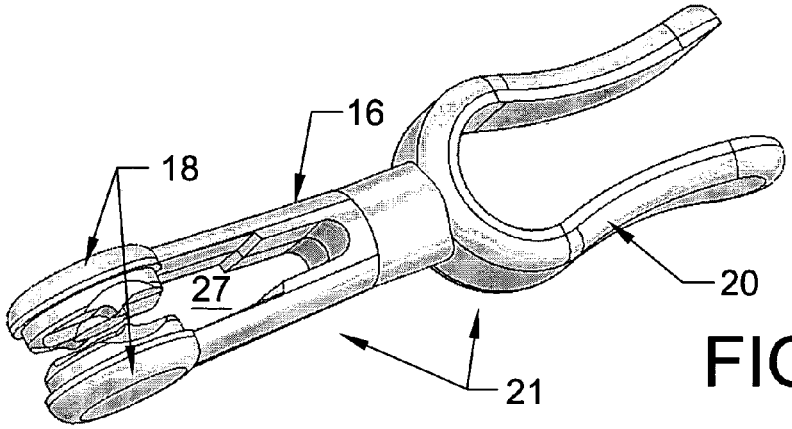
FIG. 8
FIG. 9
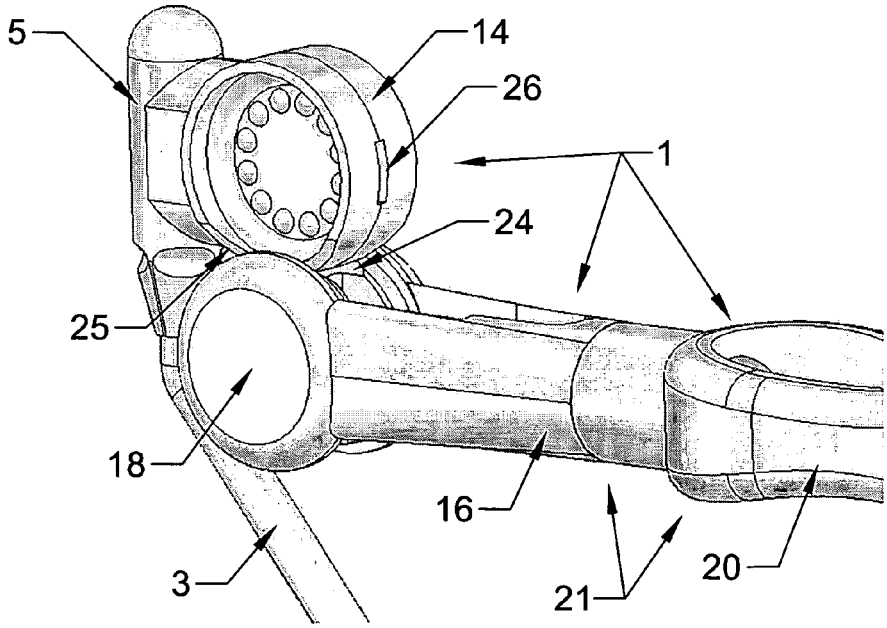

STEMWARE SAVER FOR DISHWASHER

Provisional Patent Application 60/639,507 filed Dec. 29, 2004.

BACKGROUND OF THE INVENTION

1. Field of Invention

This invention relates to an apparatus that attaches to an upright prong within the upper holding rack of a household dishwasher for holding a single stemmed glassware at a preferable orientation to permit washing and rinsing.

And more particularly it relates to an apparatus having a pivoting arm with an adjustable swiveling holding cradle that permits smaller glassware to be held in an inverted vertically aligned position and taller glassware to be inverted and leaned at an effective angle when dishwasher clearance becomes an issue.

2. Description of Related Art

The household automatic dishwasher has two characteristics detrimental to the cleaning of stemmed glassware: first, washing and rinsing is accomplished by spraying pressurized streams of water with sufficient force to dislodge dried food particles; and second, the upper holding rack intended for glasses and other small objects must be sufficiently generic in its design to accommodate a broad range of shapes. Stemmed glassware, being fragile and having a high center of gravity, often falls to the side or, worse yet, breaks during the dishwashing cycles. Furthermore, the height of stemmed glassware often exceeds the space available for vertical placement within the upper holding rack.

The present invention is an improvement over prior art that attempts to address the problem of securing stemmed glassware in household dishwashers. All prior inventions have fallen short of providing a practical solution. In addition to after-market devices, some dishwashers in today's homes include a factory installed cradling rack to accommodate stemware.

Typically, the factory device consists of an elongated cradle that extends at least half the dishwasher's depth and folds into position along one side of the dishwasher's upper holding rack. However, the factory device cannot be lifted into position unless the area surrounding the elongated cradle is empty. While suitable for dinner parties where planned cleanup is normal, the factory devices prove cumbersome for the more frequent, often unplanned occasions where only a few stemmed glasses require placement into a holding rack that is likely already partially full.

A number of after-market inventions have been introduced that are intended to secure stemmed glassware. Most of these devices are summarized in Arthurs et al., U.S. Pat. No. 6,394,285 which also identifies their deficiencies. Despite the many patents, none have proven practical in application including Arthurs' invention. Arthurs teaches a simple one-piece device made from a flexible resilient material having a molded clamping member at each end of an elongated arm. At one end a tapered bifurcated gripper clamps onto the stem of a wineglass or the like, and at the other end a bored C-clamp secures to the dishwasher rack by gripping to a horizontal wire or by sliding over a vertical prong. While simple in design and inexpensive to manufacture, Arthurs fails to specify how the suggested fixed C-clamp is to be secured to the dishwasher's plastic-coasted wire rack considering that wire rack diameters vary considerably from one model to the next. Furthermore, no consideration is given that addresses the problem of inserting the bored member over bulb-tipped wire prongs, a common feature in higher-end dishwashers. The diameter of the bulbed tip is considerably larger than that of the post below the tip. There are other reasons why the simple one-piece accessory made from a "flexible resilient material" suggested by Arthurs may prove unrealistic: the material must be sufficiently rigid to provide the necessary clamping action that holds to all wire rack diameters, yet must be sufficiently flexible to accommodate all possible stem diameters being inserted into the "gripper assembly". Also, the need to push the stemmed glass into the gripper introduces an additional unwanted hazard: if the stemware is pushed into the "gripper assembly" by holding the glass anywhere other than at the point where the stem contacts the gripper, the resulting torque applied to the stem could cause the glass to break.

Herbst et al, U.S. patent application Ser. No. 10/876,152 introduces an improved stemware grip over Arthurs' by teaching a moveable three-part spring-loaded clamping arm that is capable of grasping the wide range of stem diameters associated with different size stemware. Furthermore, Herbst et al provides an improved method of attachment to the wire holding rack. An elongated octagonal post permanently attaches to a vertical wire post within the upper or lower rack. According to Herbst, the octagonal post can accommodate up to four clamping arm members that can be positioned radially about the post. The clamping arms are designed to be easily removed and reattached to the post as needed. Both Arthurs and Herbst teach stemware securing devices that require the glass to be inverted in a completely vertical orientation. Because of height limitations in the upper rack, vertical positioning will usually restrict the use of these devices to the lower holding rack. In most cases, however, users prefer placing glassware in the upper rack with larger objects such as dishes and cookware going into the lower rack. Additionally, Herbst's device requires that the elongated octagonal posts be mounted to a vertical prong within the dishwasher rack. However, upright wire prongs are not always vertically positioned. Thus, the user may be required to bend selected wire prongs within their dishwasher into a more upright orientation. Many users may find this requirement a little too extreme. Also, the clamping arms described by Herbst have a fixed horizontal orientation outwardly extending from the mounting post. Such an orientation will likely cause interference with the placement of non-stemware items when not in use, thus necessitating the removal and reinstallation of the clamping arms for securing stemware with each washing.

SUMMARY OF THE INVENTION

One object of this invention is to provide an inexpensive three part assembly for securing stemware called the "Stemware Saver" or "Stemsaver" that can be plastic injection molded in a "family" mold without the need for complex slides in the tooling, thereby enabling the lowest possible manufacturing cost.

Another object of this invention is to provide a stemware securing device that can be easily assembled by the user without the use of fasteners.

Another object of this invention is to provide a device that secures a stemmed glassware by cradling rather than gripping the stem. Proper securing for washing and rinsing stemmed glassware can be accomplished without having to firmly grip the stem as suggested in prior art. Furthermore, gripping stemmed glassware can lead to the added risk of accidently snapping the stem either while pushing the glass into a gripping member or when secured stemware is bumped by other items being placed in the holding rack.

Another object of this invention is to provide a holding arm that can be raised or lowered by pivoting into a variety of angular orientations thereby providing numerous settings for placing stemmed glassware of differing sizes in a desired orientation within the dishwasher rack.

Another object of this invention is to expand the possible positions for securing a stemmed glass by providing a holding cradle that rotates about a pivoting arm. Thus by providing a holding arm assembly that not only can be raised or lowered but can be rotated into position, taller stemmed glassware can be rested at an angle as low as 45 degrees for effective cleaning and smaller stemmed glassware can be suspended in an inverted position. Furthermore, this assembly permits taller stemmed glassware to be rested in several optional angular positions thus avoiding other objects already placed in the holding rack.

Another object of this invention is to provide a permanently installed stemware securing device that can be folded out of the way when not in use, eliminating the need to detach and reattach securing members with each washing.

Another object of this invention is to provide means of attachment for a stemware securing device that adapts to the variations in wire rack diameters when installed in the dishwasher holding rack.

In its preferred configuration, the "Stemware Saver" assembly consists of three components: a mounting base member; a pivoting arm member; and a swiveling holding cradle member—all of which are preferably molded from a durable heat-resistant semi-flexible plastic. The mounting base member is intended to be permanently installed within the dishwasher's upper holding rack designed for drinking glasses and the like. The one-piece mounting base member is comprised of opposing halves that share a "living hinge" along one side, permitting the two halves to be folded together over the tip of an upright plastic-coated wire prong and snap closed. The folded halves are then locked into place by a bifurcated feature at one end of the pivoting arm member that slides around both sides of the mounting base member.

The bifurcated portion of the pivoting arm member terminates with a pair of opposing plugs which are designed to be inserted into corresponding sockets included within each side of the mounting base member. The plugs rotating within the sockets enable the pivoting arm to be rotated up or down. As the arm rotates, i.e pivots, a series of radially positioned bumps within bottom of both sockets mesh with ridges on the face of both plugs. Because of the spring-loading inherent in the bifurcated feature, the pivoting arm member will snap into a number of possible angular positions relative to the mounting base member.

For holding or cradling the stem of an inverted stemmed glass, a bifurcated swiveling holding cradle member is affixed to the other end of the pivoting arm member.

In its preferred configuration, the holding cradle is able to freely rotate, i.e. swivel, about the pivoting arm. With the degree of flexibility afforded by the pivoting arm and the swiveling holding cradle, the "Stemware Saver" can be adapted by the user to achieve the best position for securing a wide variety of stemmed glassware. The "Stemware Saver" is intended to be installed by the user and will likely be packaged in sets of 4 or 6. With the advantages of injection molding and because of the small size of the parts, per unit cost is made affordable even if an expensive plastic is necessary, i.e. one that can withstand the extreme environment inside the dishwasher. Because the "Stemware Saver" is easy to install, easy to use and can be folded out of the way when not it use, and because there is a widespread need for such a device, the "Stemware Saver" is an ideal product for the consumer market.

BRIEF DESCRIPTION OF THE DRAWINGS

FIG. 5 is a perspective view of the pivoting arm member illustrating the exposed plugs prior to assembly.

FIG. 6 is a detail view of the preferred surface projections and bevels formed within the plug features at the bifurcated end of the pivoting arm member.

FIG. 7 is a perspective view illustrating the socket feature at the base of the swiveling holding cradle member prior to attachment to the pivoting arm member.

FIG. 8 is a perspective view of the swiveling holding cradle member connected to the pivoting arm member prior to being attached to the mounting base member.

FIG. 9 is a perspective view of the pivoting arm assembly positioned for attachment to the mounting base member that has been installed onto an upright prong.

DESCRIPTION OF THE PREFERRED EMBODIMENT

Figure 1:
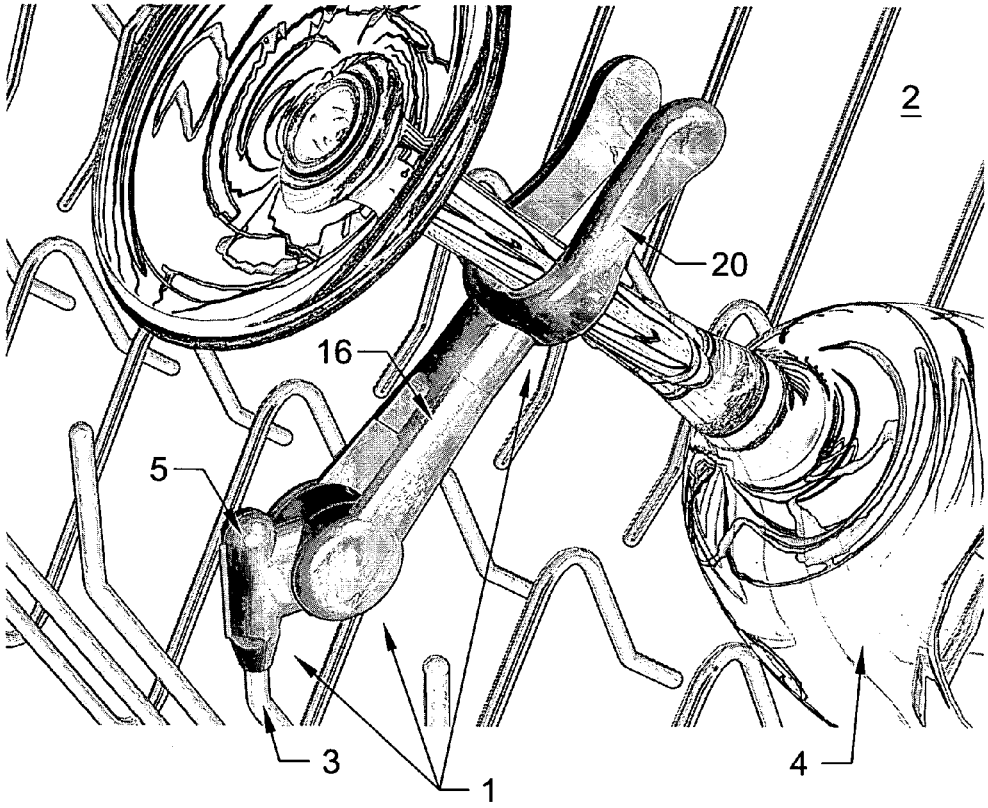
FIG. 1 is a perspective view of the assembled Stemware Saver consisting of a mounting base member, a pivoting arm member and a swiveling holding cradle member installed to an upright prong within the upper holding rack of a typical household dishwasher and shown cradling a large wine glass that is leaning at a 45 degree angle.
Figure 2:
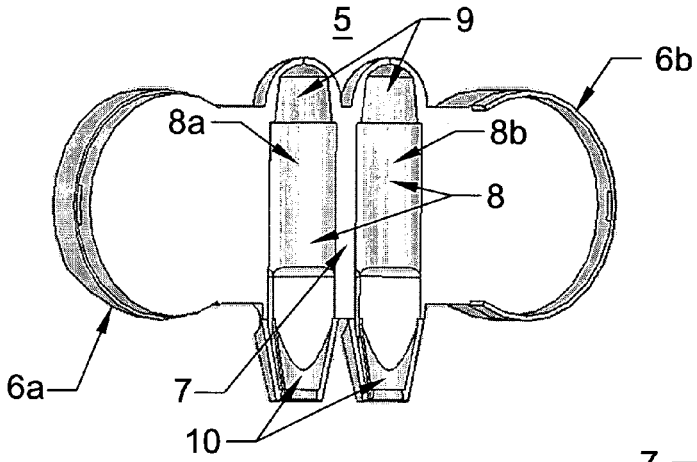
FIGS. 2 & 3 are front and back views of the mounting base member prior to being installed within the dishwasher.
Figure 3:
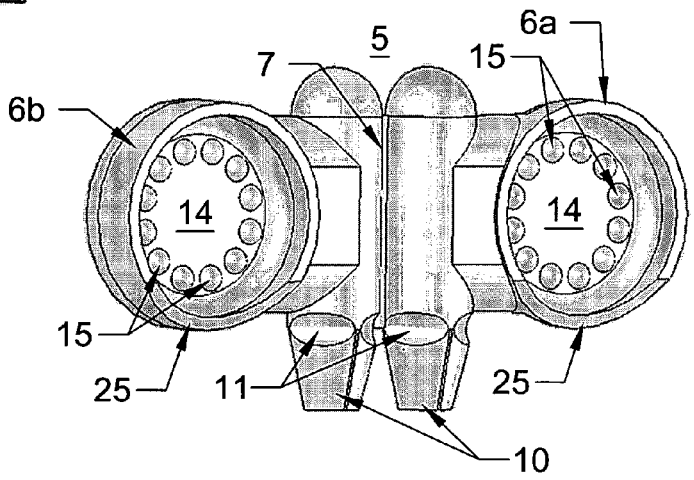

Whereas the preferred configuration of the present invention has been illustrated and described herein, it should be realized that the embodiments are to be considered in all respects illustrative and not restrictive. FIG. 1 illustrates the present invention, the Stemware Saver 1, assembled and installed within the upper holding rack 2 of a conventional household dishwasher. The Stemware Saver 1 is shown mounted to one of the upright plastic-coated wire prongs 3 and cradling a typical larger stemmed wine glass 4. The "Stemware Saver's" mounting base 5 member is comprised of female and male mirrored halves 6*a* & 6*b*, as seen in FIGS. 2 & 3, that fold and snap together. In the preferred embodiment, these mirrored halves 6*a* & 6*b* are connected along their common vertical edge by a molded hinged mechanism 7, often referred to as a "living hinge" and commonly found on plastic bottle-cap lids that snap open and closed for pouring and sealing liquids.

Each half 6*a* & 6*b* of the mounting base 5 incorporates a mating cylindrical shell feature 8*a* & 8*b*. When folded together the half cylindrical shell features 8*a* & 8*b* combine to form a complete cylindrical cavity 8 for encasing the top of a generally upright wire prong 3. The cylindrical cavity 8 forms a tapered head 9 so that as the mounting base 5 member is pushed downward the upright prong 3 becomes centered irrespective of the prong's diameter. Likewise, the cylindrical shell members 8*a* & 8*b* each include two flange members 10 that combine to form a tapered bottom portion of cylindrical cavity 8 thereby centering the prong 3 at the bottom of mounting base 5. The inwardly tapering flanges 10 are designed to splay outward as necessary to accommodate any diameter wire prong 3 commonly found in dishwasher wire racks 2.

Splaying of the four flanges 10 is made possible by an exterior horizontal groove 11 and a flattened interior surface 12 where the bend occurs in each of the flanges 10. These design elements within cylindrical cavity 8 enable the mounting base 5 to accommodate the variety of different prong 3 diameters commonly found in today's dishwasher plastic-coated wire racks, including those having with bulbed tips (not shown).

Figure 4:
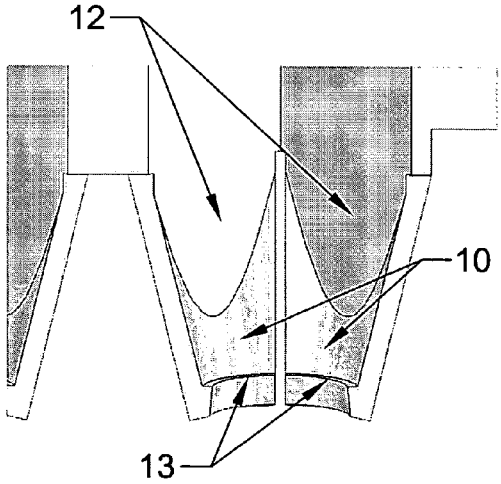
FIG. 4 is a detail inside view of the flange feature at the bottom of the mounting base member.

The splay action of the four flanges 10 provides gripping pressure to wire prong 3. FIG. 4 illustrates the interior of each flange 10 where a sawtooth-shaped ridge feature 13 makes contact with the wire prong 3, applying a locking action that prevents base 5 from inadvertently sliding upward during use yet permits the assembly 1 to be pushed down onto prong 3 during installation.

The mounting base member 5 includes a pair of round socket features 14 within mirrored halves 6*a* & 6*b* best viewed in FIGS. 2 & 3, which oppose one-another and face outward when folded together. Each socket feature 14 incorporates an array of protrusions or bumps 15 positioned radially about the socket's center that assist in locking pivoting arm member 16 in a variety of angular positions.

The pivoting arm member 16, best viewed in FIG. 5, incorporates a pair of inwardly facing round plug features 18 formed at the end of the bifurcated portion 27. During assembly of pivoting arm member 16 to mounting base member 5, the plugs 18 are inserted within the corresponding sockets 14. A preferred embodiment is shown in FIG. 6 where ridges 23 are positioned 90 degrees apart on the face of both plugs 18. This configuration enables the pivoting arm 16 to be molded in one piece without requiring complex slides within the plastic injection tooling.

In its preferred configuration, the holding cradle 20 as seen in FIG. 7 is a separate member that can be swivelled about the pivoting arm member 16. A round plug feature 17, formed at the opposite end of the pivoting arm member 16, is designed to snap into cylindrical socket feature 19 at the base of holding cradle member 20, thereby creating the pivoting arm assembly 21 shown in FIG. 8. An internal ridge 24, within the circumference of socket 19, enables a pair of opposing flanges 22, on the side of plug 17, to lock the holding cradle member 20 onto the pivoting arm member 16. Even though locked together, the round plug is capable of rotating within the cylindrical socket. Thus, the holding cradle 20 is able to swivel 360 degrees about pivoting arm 16 thereby achieving the best orientation for a particular sized glass by permitting stemmed glassware 4 to be positioned in a multitude of angles.

Figure 10:
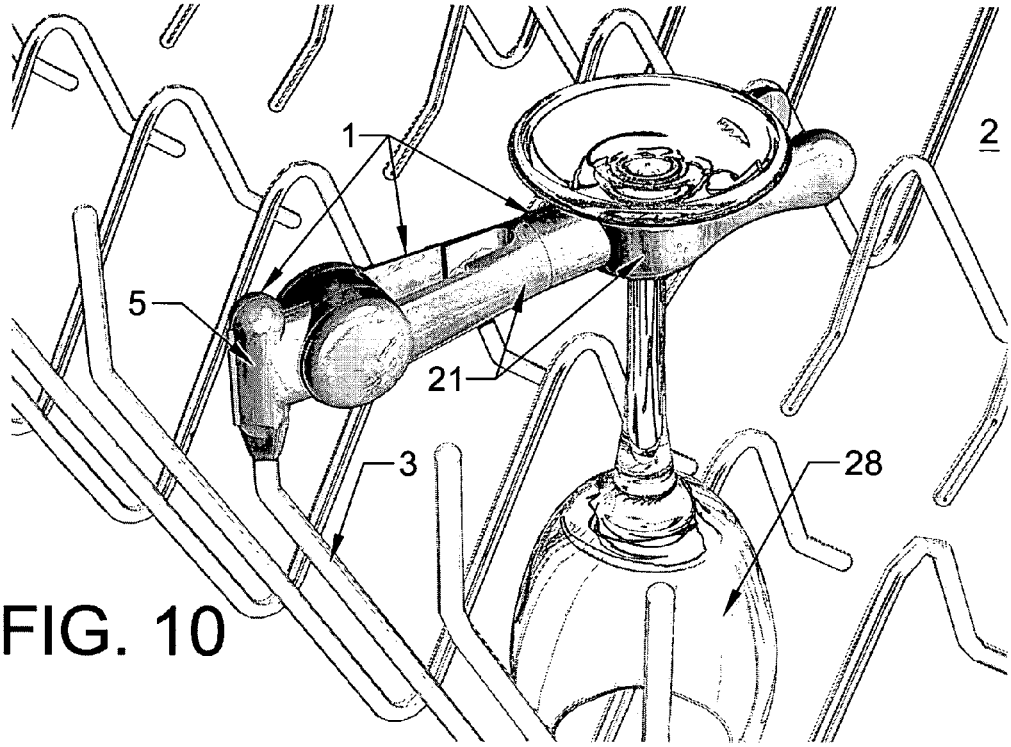
FIG. 10 is a perspective view of the assembled Stemware Saver with the pivoting arm and swiveling holding cradle members positioned to hold a small stemmed liqueur glass in a inverted manner.
Figure 11:
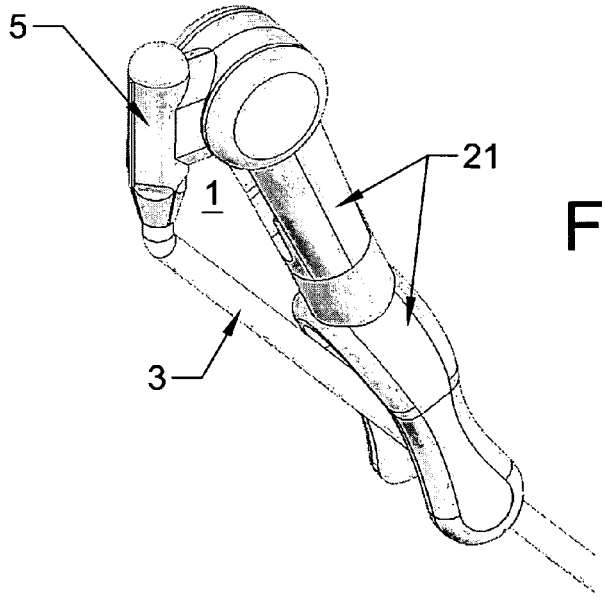
FIG. 11 is a perspective view illustrating the installed Stemware Saver folded out of the way when not in use.

The horizontal and vertical ridges 23 within both plugs 18 are designed to mesh with the spaces between projections formed as bumps 15 within both sockets 14. As the pivoting arm assembly 21 is pivoted up or down, the bifurcated portion 27 of the pivoting arm member 16 momentarily splays in order to permit ridges 23 on plugs 18 to ride over the radially oriented bumps 15 in sockets 14. The force exerted by the splaying bifurcation 27 causes the pivoting arm 16 to snap into the desired angle relative to the mounting base 5 with sufficient strength to remain stationary while securing a larger glass 4 as shown in FIG. 1 or a smaller glass 28 as shown in FIG. 10. For larger stemmed glassware 4 such as champagne flutes, beer glasses, and large wineglasses, the "Stemware Saver" would most likely be positioned as shown in FIG. 1. Prior art fails to acknowledge that limited headroom in the upper holding rack 2 of most dishwashers does not permit the vertical placement of tall stemware 4. Furthermore, adequate washing and drainage can be obtained by placing the glass 4 at an angle as low as 45 degrees. For smaller stemmed glassware 28 such as port and liqueur glasses where headroom is not an issue, the pivoting arm 16 would likely be positioned as shown in FIG. 10. Additionally, the pivoting arm assembly 21 is capable of being folded down and out of the way, as shown in FIG. 11. Unlike inventions set forth in prior art, the present invention teaches a stemware securing device that will not interfere with the placement of non-stemware items when not in use.

In my invention, both assembly and installation of the "Stemware Saver" are easily accomplished by the consumer. Referring to FIG. 9, the mounting base member 5 folds around the selected wire prong 3 and snaps closed by using fingers. To facilitate the attachment of pivoting To facilitate the attachment of pivoting arm assembly 21 to the mounting base member 5, a pair of beveled edges 24 at the top of the pivoting arm's plugs 18, also shown in FIG. 6, align with corresponding beveled rims 25 at the bottom base of both sockets 14, also shown in FIG. 3. The pivoting arm member 16 is attached to mounting base member 5 by positioning arm 16 horizontally as shown in FIG. 9, with the upwardly beveled plugs 24 aligned with the downwardly beveled rims 25. As sockets 14 and plugs 18 are squeezed into alignment, the bifurcated portion 27 of pivoting arm member 16 splays sufficiently to permit the two parts to ride over one another and to snap together, thereby seating both plugs 18 within their corresponding sockets 14 and locking the folded mounting base 5 to wire prong 3. Removal of the assembly 1 from the dishwasher rack 2 can be accomplished by first removing the pivoting arm member 16 from the mounting base member 5.

By inserting a small screwdriver into the bifurcated portion 27 of pivoting arm member 16, plugs 18 can be spread apart and removed from the sockets 14. Then by inserting the screwdriver into a rectangular slot 26 shown in FIG. 9, the folded mounting base 5 can be spread open and removed from the wire prong 3.

The type of material used in manufacturing is an important factor in the successful operation of the Stemware Saver.

Both pivoting arm 16 and mounting base 5 members must be made of a durable plastic that remains flexible after repeated exposure to harsh detergents and severe heat generated during the dishwasher's washing and drying cycles. There are many new high quality plastics that are capable of performing well under such harsh conditions. And even if a specialty, high-performance thermoplastic is necessary in order to meet the demanding requirements, because of the Stemware Saver's small size, material cost should not become a major factor in setting retail price.

What is claimed:

1. An assembled device for securing one stemmed glassware during washing and rinsing cycles of a typical household dishwasher, with said device mounting to a dishwasher's holding rack, preferably to a generally upright plastic-coated wire prong within the upper holding rack, comprising:

a mounting base member having a generally axially horizontal cylindrical section adjoining a generally axially vertical cylindrical section wherein said horizontal cylindrical section receives a mating rotatable attachment and said vertical cylindrical section attaches to said holding rack;

a pivoting arm member including said rotatable attachment that attaches to and extends outwardly from said mounting base member wherein said pivoting arm member pivots about said horizontal cylindrical section having a selection of fixed angular positions, and;

a holding cradle member that attaches to or is part of the outwardly extended portion of said pivoting arm member, with said holding cradle member being raised or lowered by rotation of said rotatable attachment into one of said fixed angular positions thereby providing means for holding, resting or otherwise securing a variety of differing sized said stemmed glassware in a preferred inverted orientation for cleaning.

2. An assembled device as in claim 1 with the base of said holding member snapping onto the end of the outwardly extended portion of said pivoting arm member, with said holding member capable of rotating 360 degrees about said pivoting arm member while being affixed to said pivoting arm member.

3. An assembled device as in claim 1 with said pivoting arm member extending into a bifurcated portion, wherein said horizontal cylindrical section mates with said rotatable attachment upon insertion of said mounting base member within said bifurcated portion during assembly.

4. An assembled device as in claim 3 with said mounting base member comprised of mating halves with a generally cylindrical shell formed within the interior of each of said halves such that when said halves are joined, the pair of said cylindrical shells join to provide said vertical cylindrical section capable of enveloping thereby gripping a segment of said holding rack, preferably the upper portion of said wire prong.

5. An assembled device as in claim 3 with said mounting base member being locked into its mounted position when placed within said bifurcated portion during assembly.

6. An assembled device as in claim 3 with said rotatable attachment of said bifurcated pivoting arm member comprising a pair of inwardly facing generally rounded plugs, and said horizontal cylindrical section of said mounting base member comprising a pair of outwardly facing generally rounded sockets, wherein said plugs fit into said sockets with both of said plugs and sockets forming radially oriented projections about a common center such that said projections in said plugs mesh with said projections in said sockets thereby causing said pivoting arm member when pivoted to snap into and sustain a number of possible angular positions relative to said mounting base member.

7. An assembled device as in claim 6 wherein said projections within each of said plugs of said pivoting arm member, generally forming horizontal and vertical ridges having an "+" shape, thereby permitting said pivoting arm member to be injection molded in one piece without the injection tooling requiring slides in order to mold said projections.

8. An assembled device as in claim 2 with said holding cradle member extending into a bifurcated portion for insertion of the stem of said stemmed glassware in an inverted position within said bifurcated portion, thereby capable of holding the bottom of said typically smaller of stemmed glassware in mostly a vertical position, or cradling the stem of said typically taller of stemmed glassware in mostly an angled position.

9. An assembled device as in claim 2 with said holding cradle member extending into a clamping portion for clamping the stem of said stemmed glassware in an inverted position, thereby capable of gripping the stem of said typically smaller of stemmed glassware in mostly a vertical position, or gripping the stem of said typically taller of stemmed glassware in mostly an angled position.

10. An assembled device as in claim 9 with said clamping portion consisting of opposing jaws whereby a fixed jaw feature extends from said base of said holding cradle member and mates with a pivotally connected jaw member, whereupon said opposing jaws include biasing means to force said opposing jaws together thereby exerting said gripping means to said stem.

11. A mounting base member as in claim 4 wherein said vertical cylindrical section includes an array of inwardly tapering flanges at one or both ends, with said flanges capable of splaying outwardly during assembly of said mounting base member to accommodate and adapt to any plastic-coated wire diameter comprising said typical holding rack, thereby providing means to grip said plastic-coated wire and anchor said mounting base member to a variety of said typical holding racks.

12. An assembled device as in claim 4 with the mounting base member being molded from a semi-flexible heat resistant material as with certain plastics, wherein said halves comprising said member are connected by a common hinge molded therein, enabling said halves to be folded together into their assembled position.

13. An assembled device as in claim 4 where said assembled mounting base member encapsulates within said vertical cylindrical section the tip of said wire prong, with said vertical cylindrical section further including inwardly tapering flanges extending downwardly therefrom and a tapered head internally formed therein, wherein:

the bottom edge of said flanges form an inwardly facing sawtooth-shaped ridge feature thereby collectively providing said gripping means to said wire prong below said tip;

said saw-toothed ridge prevents said folded mounting base member from sliding upwardly while being permitted to slide downwardly on said wire prong; and said tapered head causes the centering of said enclosed tip when said folded mounting base member is pushed downwardly on said wire prong.

14. An assembled device as in claim 2 with said holding cradle member forming a rounded socket feature at its base and said pivoting arm member forming a rounded plug feature at said outwardly extended portion wherein:

said holding cradle member attaches to said pivoting arm member by the insertion of said plug into said socket;

said plug forms a pair of opposing flanges thereon and said socket forms a circular ridge therein;

said locking means is provided by said flanges momentarily collapsing while passing over said ridge during said insertion then snapping into a relaxed position, thereby becoming anchored against said ridge; and said rotating means provided by said rounded flanged plug being unobstructed by rotation within said cylindrical socket against said ridge.

15. An assembled device as in claim 6 with the pivoting arm member molded from a semi-flexible heat resistant material as with certain plastics, wherein said bifurcated portion of said pivoting arm member:

splays sufficiently permitting said plugs to pass over said mounting base member prior to insertion of said plugs into said sockets thereby enabling said pivoting arm member to be assembled to said mounting base member; and remains marginally splayed after assembly such that a continuous inwardly directed force is exerted by said plugs against said sockets thereby enabling said pivoting arm member to retain said fixed angular positions.

* * * * *